US010309612B2

(12) United States Patent
Kim et al.

(10) Patent No.: US 10,309,612 B2
(45) Date of Patent: Jun. 4, 2019

(54) LIGHT SOURCE MODULE HAVING LENS WITH SUPPORT POSTS

(71) Applicant: Samsung Electronics Co., Ltd., Suwon-si, Gyeonggi-do (KR)

(72) Inventors: Do Hun Kim, Seoul (KR); Jeong Gyu Park, Yongin-si (KR); In Je Sung, Paju-si (KR)

(73) Assignee: Samsung Electronics Co., Ltd. (KR)

( * ) Notice: Subject to any disclaimer, the term of this patent is extended or adjusted under 35 U.S.C. 154(b) by 727 days.

(21) Appl. No.: 14/981,870

(22) Filed: Dec. 28, 2015

(65) Prior Publication Data

US 2016/0186959 A1 Jun. 30, 2016

(30) Foreign Application Priority Data

Dec. 26, 2014 (KR) ..... 10-2014-0190519

(51) Int. Cl.

| | |
|---|---|
| ***F21K 9/69*** | (2016.01) |
| ***F21V 5/04*** | (2006.01) |
| *F21V 17/10* | (2006.01) |
| *F21Y 115/10* | (2016.01) |

(52) U.S. Cl.

CPC ..... *F21V 5/04* (2013.01); *F21V 17/101* (2013.01); *F21Y 2115/10* (2016.08)

(58) Field of Classification Search

CPC . F21K 9/69; F21V 5/046; F21V 5/048; F21V 5/007; F21Y 2103/10; F21Y 2105/10; F21Y 2115/10

See application file for complete search history.

(56) References Cited

U.S. PATENT DOCUMENTS

| | | | | |
|---|---|---|---|---|
| 6,372,608 | B1 | 4/2002 | Shimoda et al. | |
| 6,645,830 | B2 | 11/2003 | Shimoda et al. | |
| RE38,466 | E | 3/2004 | Inoue et al. | |
| 6,755,556 | B2 * | 6/2004 | Gasquet | F21V 5/04 362/329 |
| 6,818,465 | B2 | 11/2004 | Biwa et al. | |
| 6,818,530 | B2 | 11/2004 | Shimoda et al. | |
| 6,858,081 | B2 | 2/2005 | Biwa et al. | |
| 6,967,353 | B2 | 11/2005 | Suzuki et al. | |
| 6,978,068 | B2 | 12/2005 | Wilson et al. | |
| 7,002,182 | B2 | 2/2006 | Okuyama et al. | |
| 7,084,420 | B2 | 8/2006 | Kim et al. | |
| 7,087,932 | B2 | 8/2006 | Okuyama et al. | |
| 7,154,124 | B2 | 12/2006 | Han et al. | |
| 7,208,725 | B2 | 4/2007 | Sherrer et al. | |
| 7,288,758 | B2 | 10/2007 | Sherrer et al. | |
| 7,319,044 | B2 | 1/2008 | Han et al. | |

(Continued)

FOREIGN PATENT DOCUMENTS

| | | |
|---|---|---|
| JP | 2003163382 | 6/2003 |
| JP | 200570107 | 3/2005 |

(Continued)

*Primary Examiner* — Ismael Negron

(74) *Attorney, Agent, or Firm* — Renaissance IP Law Group LLP

(57) ABSTRACT

A light source module includes a substrate, a light source mounted on the substrate, an optical device disposed on the light source, a support extending from a surface of the optical device facing the light source and fixed to the substrate, and a protrusion extending from and around a side surface of the support.

18 Claims, 15 Drawing Sheets

(56) References Cited

U.S. PATENT DOCUMENTS

| | | | | |
|---|---|---|---|---|
| 7,501,656 | B2 | 3/2009 | Han et al. | |
| 7,514,718 | B2 | 4/2009 | Shin et al. | |
| 7,709,857 | B2 | 5/2010 | Kim et al. | |
| 7,759,140 | B2 | 7/2010 | Lee et al. | |
| 7,781,727 | B2 | 8/2010 | Sherrer et al. | |
| 7,790,482 | B2 | 9/2010 | Han et al. | |
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,052,307 | B2 * | 11/2011 | Bak | F21V 5/04 362/249.02 |
| 8,129,711 | B2 | 3/2012 | Kang et al. | |
| 8,179,938 | B2 | 5/2012 | Kim | |
| 8,182,110 | B2 * | 5/2012 | Jiang | F21V 5/04 362/245 |
| 8,226,276 | B2 | 7/2012 | Pachler et al. | |
| 8,263,987 | B2 | 9/2012 | Choi et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,459,832 | B2 | 6/2013 | Kim | |
| 8,502,242 | B2 | 8/2013 | Kim | |
| 8,536,604 | B2 | 9/2013 | Kwak et al. | |
| 8,622,594 | B2 | 1/2014 | Ishio et al. | |
| 8,735,931 | B2 | 5/2014 | Han et al. | |
| 8,766,295 | B2 | 7/2014 | Kim | |
| 8,823,048 | B2 | 9/2014 | Lee et al. | |
| 8,939,618 | B2 * | 1/2015 | Kawahara | F21V 5/04 362/311.09 |
| 8,967,835 | B2 * | 3/2015 | Tseng | F21V 17/18 362/311.02 |
| 8,981,631 | B2 * | 3/2015 | Lin | G02B 6/003 313/110 |
| 9,404,647 | B2 * | 8/2016 | Duckworth | F21V 25/12 |
| 2003/0235050 | A1 * | 12/2003 | West | F21V 5/04 362/327 |
| 2006/0044806 | A1 * | 3/2006 | Abramov | F21V 5/007 362/337 |
| 2006/0208267 | A1 * | 9/2006 | Chin | H01L 33/58 257/98 |
| 2008/0100773 | A1 * | 5/2008 | Hwang | G02B 3/005 349/62 |
| 2011/0032707 | A1 * | 2/2011 | Takashige | F21V 5/04 362/277 |
| 2012/0248977 | A1 | 10/2012 | Ootorii | |
| 2017/0153005 | A1 * | 6/2017 | Cho | G02B 19/0014 |

FOREIGN PATENT DOCUMENTS

| | | |
|---|---|---|
| KR | 100645758 | 11/2006 |
| KR | 20130059875 | 6/2013 |

* cited by examiner

LIGHT SOURCE MODULE HAVING LENS WITH SUPPORT POSTS

CROSS-REFERENCE TO RELATED APPLICATION

This application claims the priority and benefit of Korean Patent Application No. 10-2014-0190519 filed on Dec. 26, 2014, with the Korean Intellectual Property Office, the inventive concept of which is incorporated herein by reference.

BACKGROUND

The present inventive concept relates to a light source module.

Among lenses used in light source modules, a lens having wide beam angle may be used to spread light laterally from a center portion across a large area using the refraction of light. However, when a lens is attached to a substrate in a process of fabricating a light source module, an adhesive may be spread and partly stuck to the lens. Due to the presence of the adhesive on the lens, light emitted by the light source may move along a changed optical path. Accordingly, light emitted externally from the lens may not uniformly spread. In addition, the non-uniform distribution of light may result in poor optical uniformity, such as generation of speckles or mura, in lighting apparatuses or display devices.

In addition, since a lens attachment process is required in addition to a light-source attachment process, manufacturing costs and time may be increased.

SUMMARY

An aspect of the present inventive concept may provide a method of preventing generation of speckles to uniformize light distribution.

Another aspect of the present inventive concept may provide a method of simplifying processes of fabricating a light source.

According to an aspect of the present inventive concept, a light source module may include a substrate, a light source mounted on the substrate, and an optical device disposed on the light source. The optical device may include a first plane surface facing the light source, a second plane surface disposed opposite to the first plane surface and through which light generated in the light source is emitted externally, and a support disposed on the first plane surface and fixed to the substrate. The support may include a protrusion protruding around a side surface thereof.

The protrusion may have a structure extending from a portion spaced apart from the first plane surface in a lateral direction perpendicular to a longitudinal direction of the support.

The protrusion may be spaced apart from an upper surface of the substrate and disposed above the substrate.

The protrusion may be formed of the same material as the support and formed integrally with the support.

The protrusion may have a ring shape including a through-hole, and may be inserted into and fixed to the support through the through-hole.

The first plane surface may include a groove depression recessed in a light-emitting direction in a center portion thereof through which an optical axis of the light source passes.

The groove depression may be disposed to face the light source above the light source, and a cross-sectional area of the groove depression exposed on the first plane surface may be greater than an area of a light-emitting plane of the light source.

The second plane surface may convexly protrude in a moving direction of light, and a central portion thereof through which an optical axis of the light source passes may be concavely recessed toward the light source to have an inflection point.

The second plane surface may include a first curved surface having a concavely curved surface recessed along an optical axis toward the light source, and a second curved surface having a convexly curved surface extending continuously from an edge of the first curved surface to the edge of the first plane surface.

According to another aspect of the present inventive concept, a light source module may include a substrate, a light source mounted on the substrate, and an optical device disposed on the light source. The optical device may include a first plane surface facing the light source, a second plane surface disposed opposite to the first plane surface and through which light generated in the light source is emitted externally, and a first support disposed on the first plane surface and a second support disposed on an end portion of the first support and fixed to the substrate by an adhesive. The second support may include a protrusion protruding around a side surface thereof.

The protrusion may have a structure extending from an end portion of the second support in contact with the first support in a lateral direction perpendicular to a longitudinal direction of the second support, and prevents the adhesive coated on the end portion of the second support from spreading into the first plane surface along the first support.

The second support may include a fastening hollow into which the first support is partially inserted and fastened, on a surface in contact with the first support.

The second support may be formed of a resin or a metal.

The adhesive may include an epoxy adhesive or a solder cream.

The light source may be a light-emitting diode (LED) chip or an LED package in which the LED chip is mounted.

BRIEF DESCRIPTION OF DRAWINGS

The above and other aspects, features and advantages of the present inventive concept will be more clearly understood from the following detailed description taken in conjunction with the accompanying drawings, in which.

DETAILED DESCRIPTION

Figure 1A:
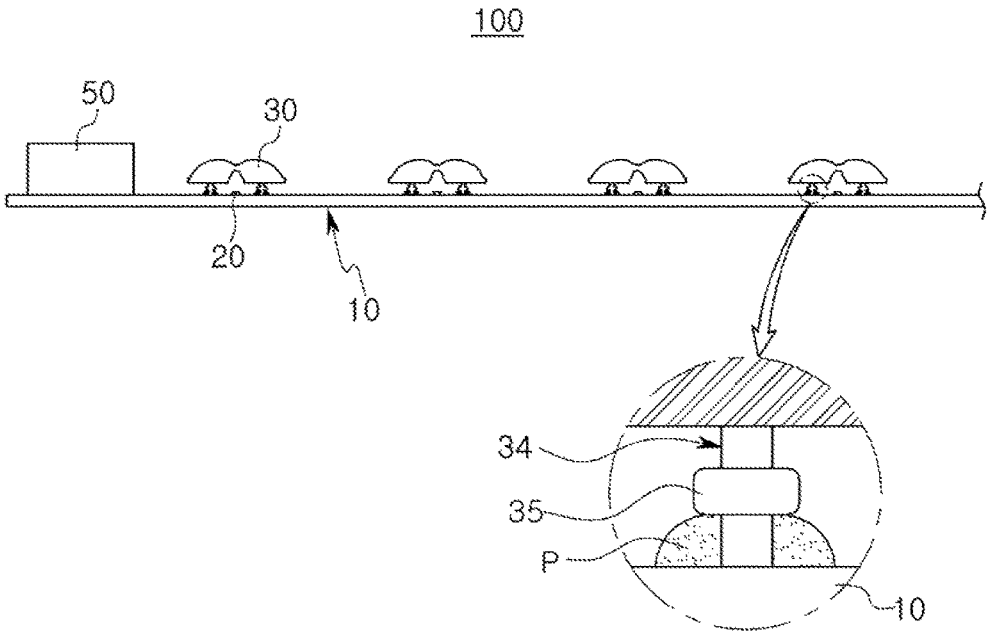
FIGS. 1A and 1B are respectively a cross-sectional view and a plan view schematically illustrating a light source module according to an exemplary embodiment of the present inventive concept.

Various embodiments will now be described more fully with reference to the accompanying drawings in which some embodiments are shown. The present disclosure may, however, be embodied in different forms and should not be construed as limited to the embodiments set forth herein. Rather, these embodiments are provided so that this disclosure is thorough and complete and fully conveys the present disclosure to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term. "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the present disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Meanwhile, when an embodiment can be implemented differently, functions or operations described in a particular block may occur in a different way from a flow described in the flowchart. For example, two consecutive blocks may be performed simultaneously, or the blocks may be performed in reverse according to related functions or operations.

Figure 1B:
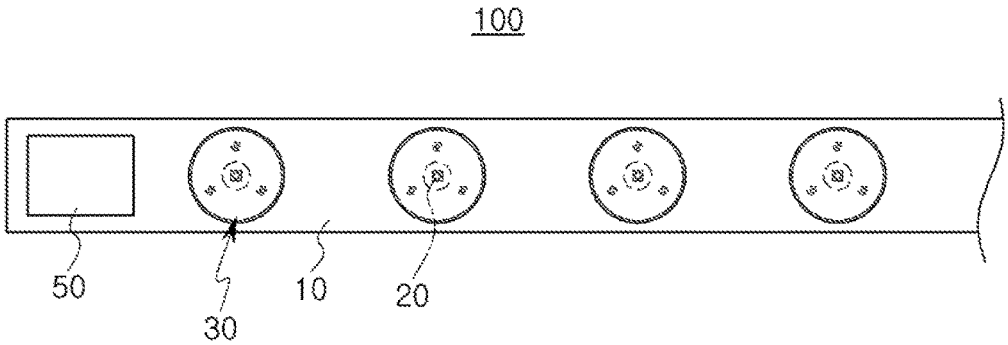

A light source module according to an exemplary embodiment of the present inventive concept will be described with reference to FIGS. 1 and 2. FIGS. 1A and 1B are respectively a cross-sectional view and a plan view schematically illustrating a light source module according to an exemplary embodiment of the present inventive concept, and FIG. 2 is a perspective view schematically illustrating a substrate, and a light source and an optical device mounted on the substrate.

Figure 2:
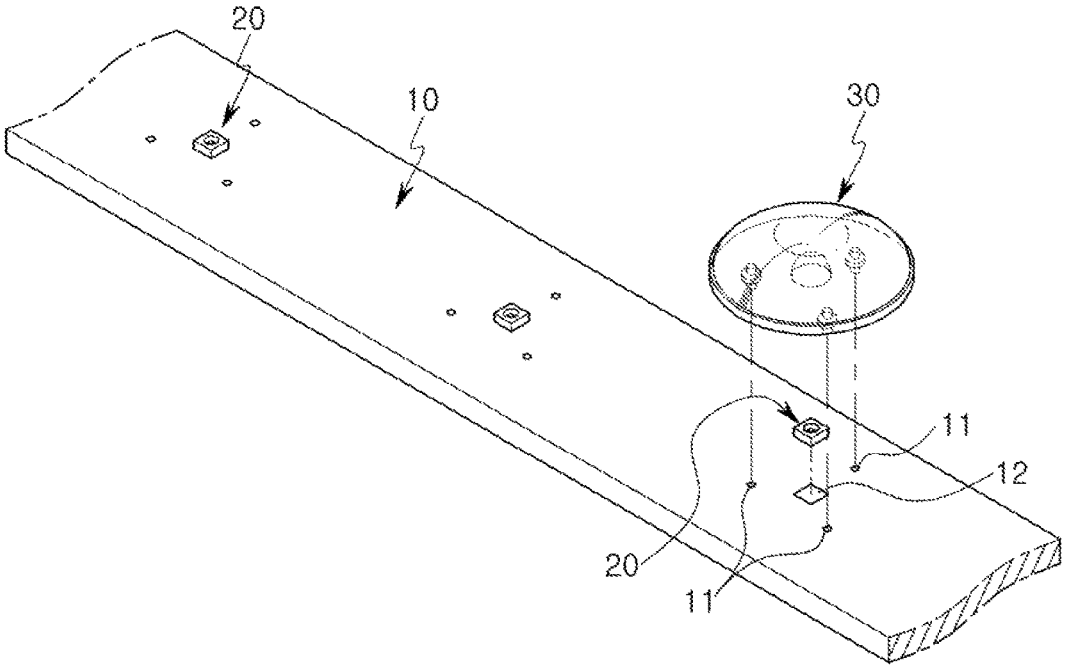
FIG. 2 is a perspective view schematically illustrating a substrate, and a light source and an optical device mounted on the substrate.

Referring to FIGS. 1 and 2, a light source module 100 according to an exemplary embodiment of the present inventive concept may include a substrate 10, a light source 20 mounted on the substrate 10, and an optical device 30 disposed on the light source 20.

The substrate 10 may be an FR4-type printed circuit board (PCB) or a flexible PCB, and may be formed of organic resin including an epoxy, triazine, silicone, polyimide, or the like, or another type of organic resin. In addition, the substrate 10 may be formed of a ceramic material, such as silicon nitride, AlN, $Al_2O_3$, or a metal or metal compound, such as MCPCB or MCCL.

The substrate 10 may have a bar-type structure having a rectangular shape elongated in a longitudinal direction. However, such a structure of substrate 10 is only an example, and the present inventive concept may not be limited thereto. The substrate 10 may have various structures corresponding to structures of products mounted thereto.

Referring to FIG. 2, the substrate 10 may include a fiducial mark 11 and a light source mounting area 12. The fiducial mark 11 and the light source mounting area 12 may guide positions at which the optical device 30 and the light source 20 to be described later are mounted. A plurality of fiducial marks 11 may be arranged around each light source mounting area 12.

In addition, the substrate 10 may include a circuit pattern (not illustrated) electrically connected to the light source 20.

A plurality of light sources 20 may be mounted on a surface of the substrate 10 and arranged in the longitudinal direction. The light source 20 may be a photoelectric device that generates light having a predetermined wavelength by an external applied driving power. For example, the light source 20 may include a semiconductor light-emitting diode (LED) having an n-type semiconductor layer, a p-type semiconductor layer, and an active layer disposed therebetween.

The light source 20 may emit blue light, green light, or red light depending on a material contained therein or a combination with a phosphor, or emit white light, UV light, or the like.

As the light source 20, a light-emitting diode (LED) chip having a variety of structures or a light-emitting diode package including the light-emitting diode chip mounted therein may be used.

Figure 3:
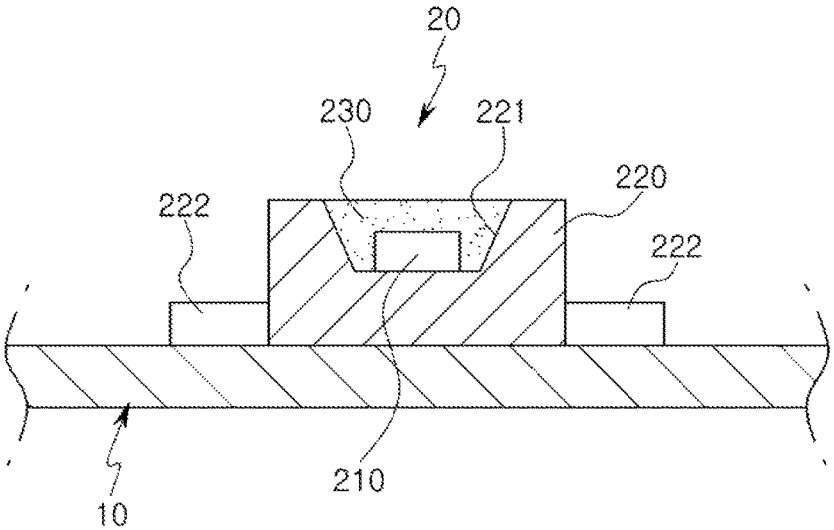
FIG. 3 is an enlarged cross-sectional view schematically illustrating a light source.

FIG. 3 schematically illustrates the light source 20. As illustrated in FIG. 3, the light source 20 may have, for example, a package structure in which an LED chip 210 is mounted in a package body 220 including a reflective cup 221. In addition, the LED chip 210 may be covered by an encapsulant 230 containing a phosphor. In the exemplary embodiment of the present inventive concept, the light source 20 is illustrated as an LED package, but is not limited thereto.

The package body 220 may correspond to a base member on which the LED chip 210 is mounted and supported, and may be formed of a white molding compound having high level of reflectance. The white molding compound may function to reflect light emitted from the LED chip 210 to increase an amount of light emitted to an exterior.

The white molding compound may include a thermosetting resin-based material or a silicone resin-based material, having a high degree of thermal resistance. In addition, a white pigment and filler, a curing agent, a release agent, an antioxidant, an adhesion-improving agent, and the like, may be added to a thermoplastic resin-based material. In addition, the white molding compound may be formed of FR-4, CEM-3, an epoxy material, a ceramic material, or the like. Further, the white molding compound may be formed of a metal such as aluminum (Al).

The package body 220 may include a lead frame 222 for forming an electrical connection to an external power source. The lead frame 222 may be formed of a material having excellent electrical conductivity, for example, a metal, such as Al or Cu. When the package body 220 is formed of a metal, an insulating material may be interposed between the package body 220 and the lead frame 222.

In the reflective cup 221 of the package body 220, the lead frame 222 may be exposed on a bottom surface on which the LED chip 210 is mounted. In addition, the LED chip 210 may be electrically connected to the exposed lead frame 222.

A cross-sectional area of the reflective cup 221 exposed on a top surface of the package body 220 may be greater than an area of the bottom surface of the reflective cup 221. Here, the cross-section of the reflective cup 221 exposed on the top surface of the package body 220 may define a light-emitting plane of the light source 20.

The LED chip 210 may be encapsulated by the encapsulant 230 formed in the reflective cup 221 of the package body 220. The encapsulant 230 may include a wavelength-converting material.

The wavelength-converting material may include, for example, at least one type of phosphor excited by light generated by the LED chip 210 and emitting light having a wavelength different from the light generated by the LED chip 210. Through the wavelength-converting material, various colors of light including white light may be emitted.

For example, when the LED chip 210 emits blue light, white light may be emitted through a combination thereof with yellow, green, red, and/or orange phosphors. Also, the LED chip 210 may be configured to include at least one of LED chips emitting purple, blue, green, red, and infrared light. In this case, the LED chip 210 may control a color rendering index (CRI) in a range from about 40 to about 100, and may generate a variety of white light having a color temperature in a range of about 2,000K to about 20,000K. In addition, the LED chip 210 may emit visible light having a purple, blue, green, red, or orange color, or infrared light as needed, and control the color according to an environment or mood. In addition, the LED chip 210 may emit light having a specific wavelength to promote plant growth.

Figure 11:
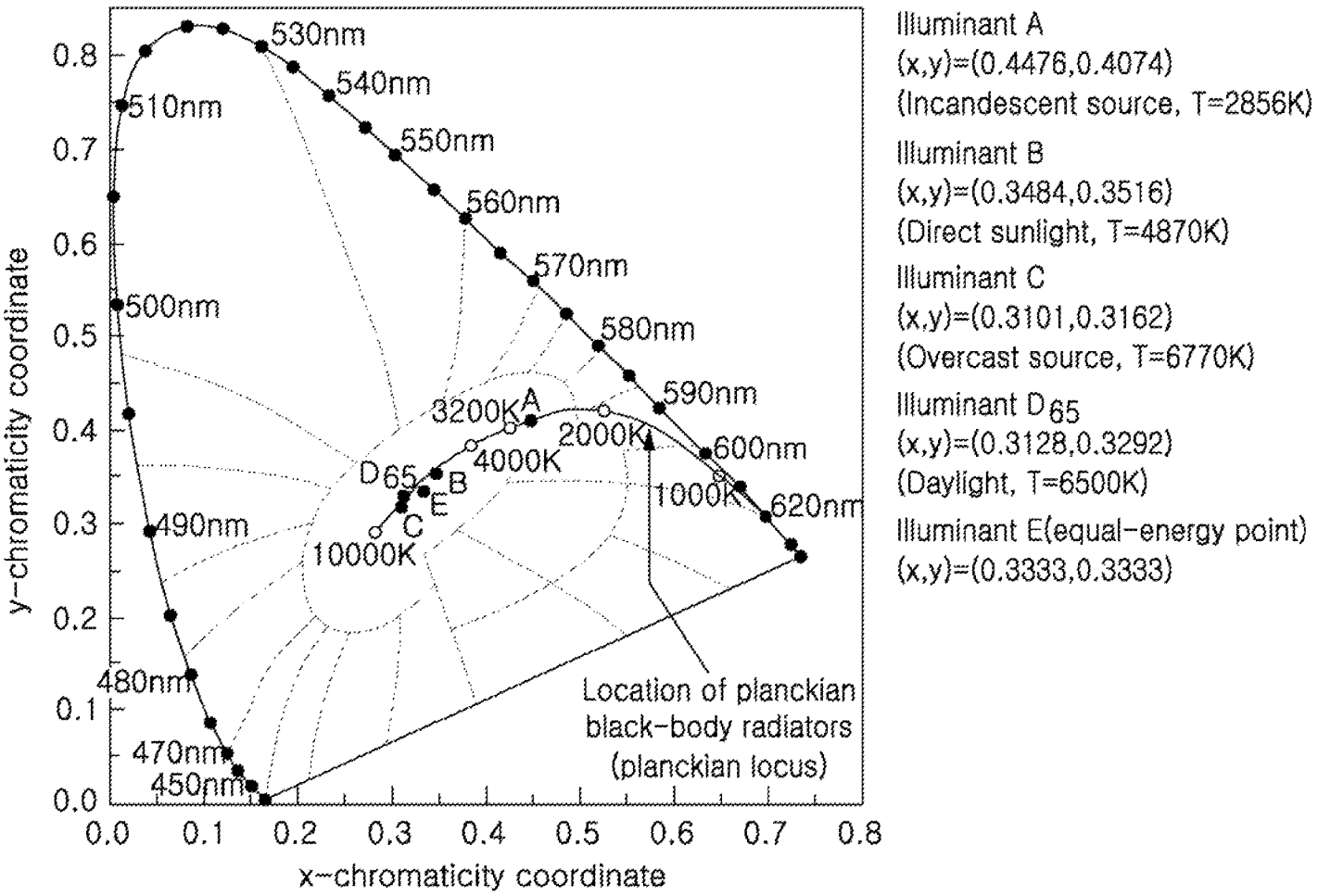
FIG. 11 is a CIE 1931 coordinate system for explaining a wavelength conversion material employable in an exemplary embodiment of the present inventive concept.

White light generated by combining yellow, green, and red phosphors with a blue LED and/or combining at least one of green LED and red LED therewith may have two or more peak wavelengths, and may be located on the line connecting (x, y) coordinates of (0.4476, 0.4074), (0.3484, 0.3516), (0.3101, 0.3162), (0.3128, 0.3292), (0.3333, 0.3333) in the CIE 1931 chromaticity diagram illustrated in FIG. 11. Alternatively, the white light may be located in a zone surrounded by the line and a black body radiation spectrum. The color temperature of the white light may be in a range of about 2,000K to about 20,000K.

Phosphors may have a compositional formula and colors as follows.

Oxide group: yellow and green $Y_3Al_5O_{12}$:Ce, $Tb_3A1_5O_{12}$:Ce, $Lu_3Al_5O_{12}$:Ce Silicate group: yellow and green $(Ba, Sr)_2SiO_4$:Eu, yellow and orange $(Ba, Sr)_3SiO_5$:Ce Nitride group: green β-SiAlON:Eu, yellow $La_3Si_6N_{11}$:Ce, orange α-SiAlON:Eu, red $CaAlSiN^3$:Eu, $Sr_2Si_5N_8$:Eu, $SrSiAl_4N_7$:Eu, $SrLiAl_3N_4$:Eu, $Ln_{4-x}(Eu_zM_{1-z})_xSi_{12-y}Al_yO_{3+x+}N_{18-x-y}$ ($0.5 \leq x \leq 3$, $0<z<0.3$, and $0<y \leq 4$) (Here, Ln is at least one element selected from the group consisting of a group IIIa element and a rare earth element, and M is at least one element selected from the group consisting of Ca, Ba, Sr, and Mg.)

Fluoride group: KSF-based red $K_2SiF_6:Mn^{4+}$, $K_2TiF_6:Mn^{4+}$, $NaYF_4:Mn^{4+}$, $NaGdF_4:Mn^{4+}$ The compositions of phosphor need to conform to stoichiometric requirements, and each element may be substituted with a different element within a corresponding group in the periodic table. For example, Sr may be substituted with Ba, Ca, or Mg in the alkaline-earth (II) group and Y may be substituted with Tb, Lu, Sc, or Gd in the lanthanide group. In addition, an activator, Eu, may be substituted with Ce, Tb, Pr, Er, or Yb depending on a preferred energy level. The activator may be used alone, or a co-activator may be additionally used to change characteristics thereof.

In addition, a material such as a quantum dot (QD) may be used as an alternative material for phosphor, and the phosphor and the QD may be used in combination or alone.

The QD may have a structure consisting of a core (having a radius of about 3 nm to 10 nm), such as CdSe and InP, a shell (having a thickness of about 0.5 nm to 2 nm), such as ZnS and ZnSe, and a ligand for stabilizing the core and shell, and implement a variety of colors according to sizes thereof.

Referring to FIG. 1 and FIG. 2, the optical device 30 may be mounted on the substrate 10, and may cover the plurality of light sources 20. The number of the optical devices 30 may correspond to the number of the light sources 20. In addition, the optical device 30 may be mounted on the substrate 10 so as to cover each light source 20 through the fiducial mark 11 corresponding to each light source mounting area 12.

Meanwhile, the substrate 10 may further include a connector 50 for connecting the light source 20 to an external power source, in addition to the plurality of light sources 20 and optical devices 30. The connector 50 may be mounted on an end portion of the substrate 10.

Hereinafter, various exemplary embodiments of an optical device used in the light source module will be described in more detail.

Figure 4:
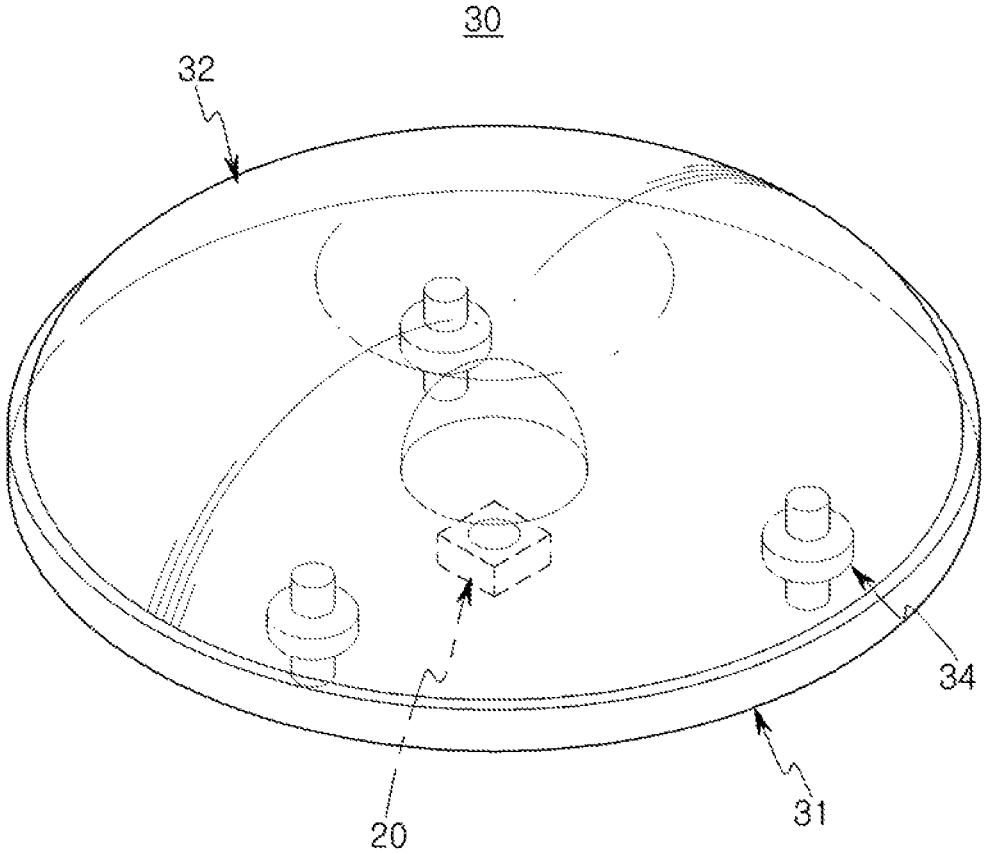
FIG. 4 is a perspective view schematically illustrating an optical device of FIG. 1.

An optical device applicable to a light source module according to an exemplary embodiment of the present inventive concept will be described with reference to FIGS. 4 to 6. FIG. 4 is a perspective view schematically illustrating the optical device, FIG. 5 is a cross-sectional view of FIG. 4, and FIG. 6 is a bottom view of FIG. 4.

Figure 5:
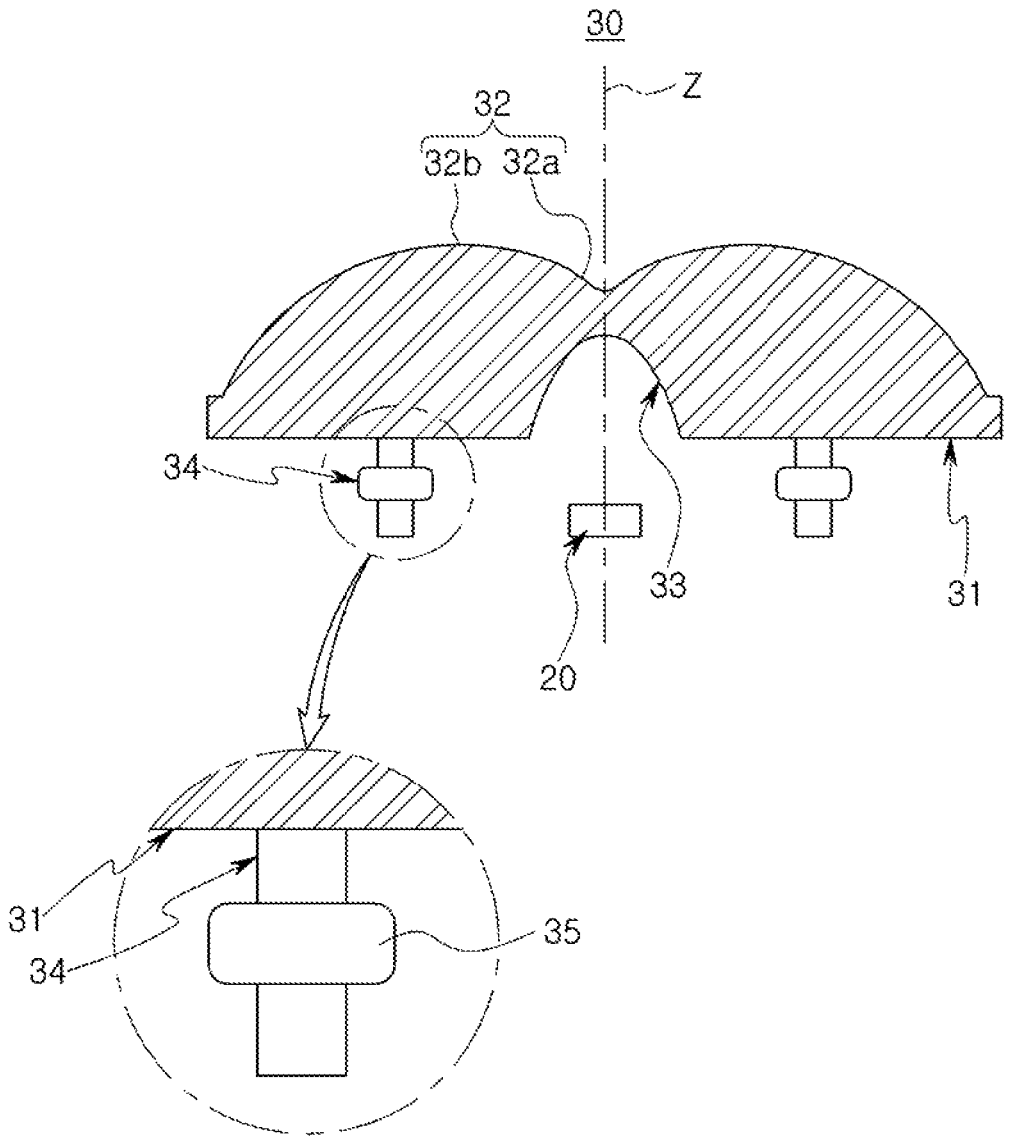
FIG. 5 is a cross-sectional view of FIG. 4.
Figure 6:
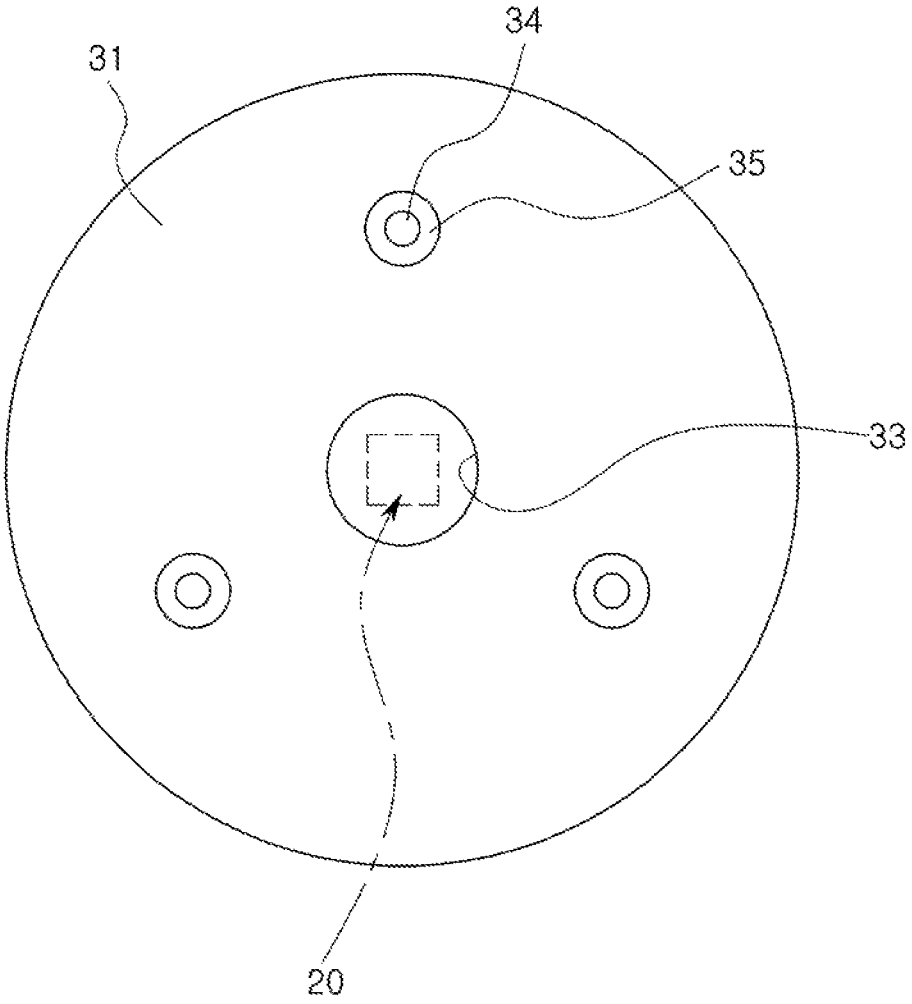
FIG. 6 is a bottom view of FIG. 4.

Referring to FIGS. 4 to 6, an optical device 30 may be disposed on a light source 20 to control beam angle of light emitted by the light source 20. Here, the light source 20 may include, for example, a light-emitting device package. In addition, the optical device 30 may include a wide beam angle lens spreading light emitted from a light-emitting device package to implement a wide beam angle.

As illustrated in FIGS. 4 and 5, the optical device 30 may include a first plane surface 31 disposed on or above the light source 20, a second plane surface 32 disposed opposite to the first plane surface 31, and a support 34 disposed on the first plane surface 31.

The first plane surface 31 may be a surface disposed on or above the light source 20 and facing the light source 20, and may correspond to a bottom surface of the optical device 30. The first plane surface 31 may have a flat circular-shaped cross-sectional structure overall in plan view.

The first plane surface 31 may include a groove depression 33 recessed in a light-emitting direction in the center portion through which an optical axis Z of the light source 20 passes. The groove depression 33 may have a structure rotationally symmetrical with respect to the optical axis Z, and a surface of the groove depression 33 thereof may be defined as a plane of incidence on which light emitted by the light source 20 is incident. Accordingly, light generated by the light source 20 may pass through the groove depression 33 to proceed to the inside of the optical device 30.

The groove depression 33 may be open to the exterior through the first plane surface 31. A cross-sectional area of the groove depression 33 thereof exposed to the first plane surface 31 may be greater than an area of the light-emitting plane of the light source 20. In addition, the groove depression 33 may be disposed above the light source 20 to face the light source 20 and cover the light source 20.

The second plane surface 32 may be disposed opposite to the first plane surface 31. The second plane surface 32 may define a light-emitting plane in which light entered through the groove depression 33 is emitted to the exterior, and corresponds to an upper surface of the optical device 30. An optical axis Z may pass through a central portion of the second plane surface 32. The second plane surface 32 may have an overall dome shape, bulged upwardly, that is, in the light-emitting direction, from an edge connected to the first plane surface 31, and the central portion is concavely recessed toward the groove depression 33 to have an inflection point.

As illustrated in FIG. 5, the second plane surface 32 may include a first curved surface 32*a* recessed along the optical axis Z toward the groove depression 33 to have a concavely curved surface, and a second curved surface 32*b* extending continuously from an edge of the first curved surface 32*a* to the edge of the first plane surface 31 to have a convexly curved surface.

The support 34 may protrude from the first plane surface 31 toward the substrate 10, and at least two supports 34 may be included. In addition, the support 34 may be arranged around the groove depression 33. In the exemplary embodiment of the present disclosure, three supports 34 may be arranged, but the number of the support 34 may vary as needed. A plurality of the supports 34 may be arranged around the groove depression 33 or the light source 20. The plurality of the supports 34 may be fixed at the points that will keep the optical device in a stable state. In one embodiment, the support 34 may be formed of the same material as the optical device 30. In another embodiment, the support 34 may be formed of a metal, which may refer to the support 34 made of metal or coated with a metal.

Figure 7:
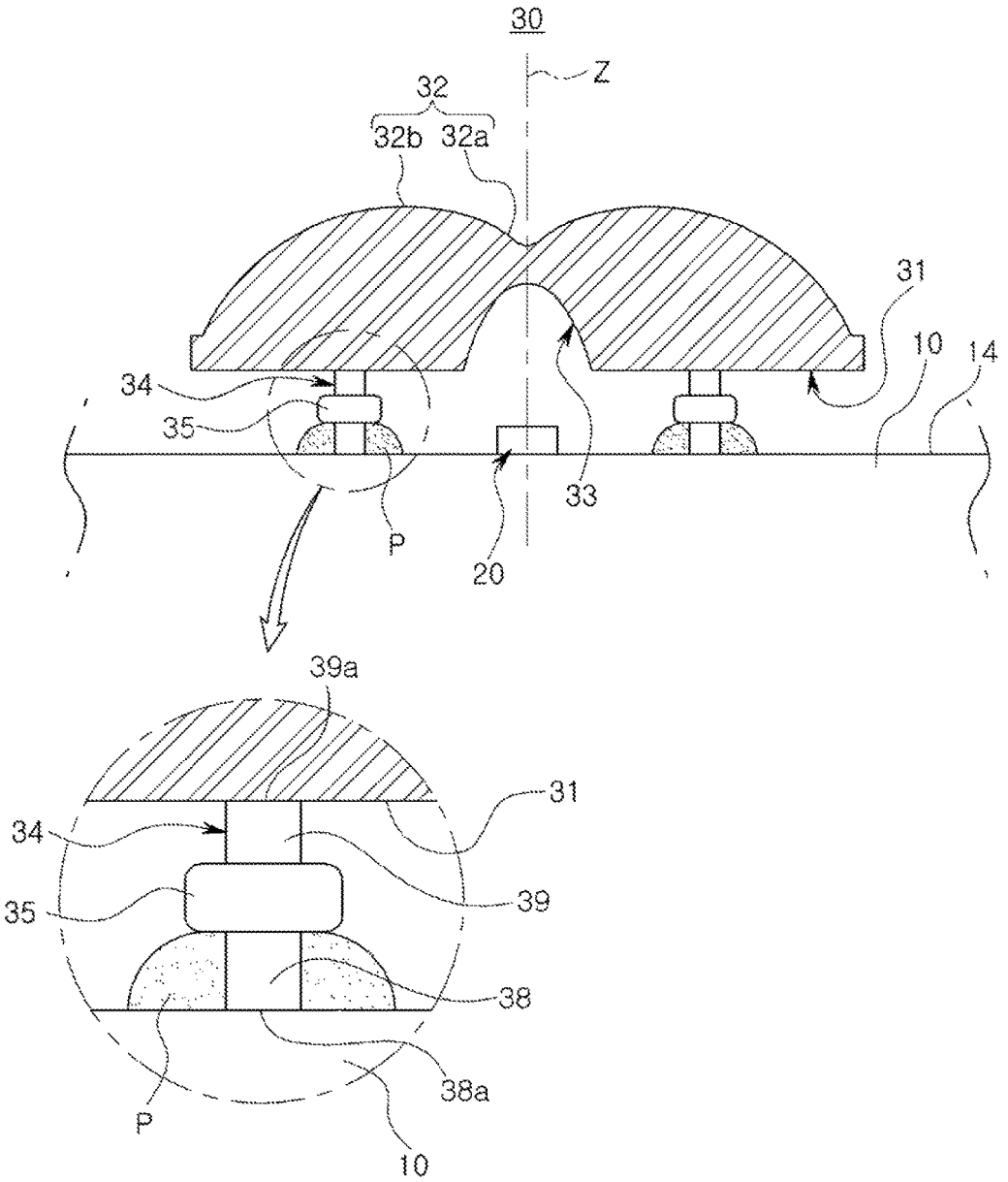
FIG. 7 is a cross-sectional view schematically illustrating a state in which an optical device is attached to a substrate by an adhesive.

FIG. 7 schematically illustrates a state in which the optical device 30 is attached to the substrate 10 by an adhesive P.

As illustrated in FIG. 7, the support 34 may be fixed to a top surface 14 of the substrate 10 by the adhesive P, when the optical device 30, for example, is mounted on the substrate 10. In addition, the first plane surface 31 may be disposed on or above the light source 20, and the groove depression 33 may face the light source 20.

The support 34 may have a bar-shaped structure, and extend in a longitudinal direction parallel to the optical axis Z. In some embodiments, the support 34 may include a lower portion 38 having a bar-shaped structure with a lower end 38*a* mounted to the top surface 14 of the substrate and an upper portion 39 having a bar-shaped structure with an upper end 39*a* disposed on the first plane surface 31. The support 34 may include a protrusion 35 radially protruding from a side surface thereof. The protrusion 35 may be in a middle portion between the lower portion 38 and the upper portion 39. In some embodiments, the protrusion 35 may be located in a substantially central position of the support 34 in a longitudinal direction. In some embodiments, the protrusion 35 may be located away from the central position of the support 34 in the longitudinal direction. A cross section of the lower portion 38 and the upper portion 39 may be of any suitable shapes such as circular, square, rectangular, or hexagonal. A cross-sectional area of the lower portion 38 and the upper portion 39 may be the same or different. An edge portion of the protrusion 35 may be of any suitable shapes such as circular, square, rectangular, or hexagonal shape.

The protrusion 35 may be spaced apart from the first plane surface 31 by a first predetermined distance and spaced apart from the top surface 14 of the substrate 10 by a second predetermined distance. The first predetermined distance and the second predetermined distance may be the same or different. The protrusion 35 may extend in a lateral direction, that is, perpendicular to a longitudinal direction of the support 34. For example, the protrusion 35 may extend in a disc shape, concentric with an axis passing through a center of the bar-shaped structure of the support 34.

The protrusion 35 may have a structure such as an engaging shoulder in a substantially central position of the support 34 in a longitudinal direction, and function as a sort of stopper blocking movement of the adhesive P coated on an end portion or the lower end of the support 34. The movement or spreading of the adhesive P may occur during a reflow process which will be described later. In some embodiments, the support 34 may be configured to have a structure or a dimension according to a reflow process. For example, the size and the location of the protrusion 35 of the support 34 may be determined according to the movement or moving path of the adhesive during the reflow process. For example, an area of protrusion in plan view and a distance of the protrusion to the top surface 14 of the substrate or a length of the lower portion 38 of the support 34 may be determined based on the reflow process such that the adhesive P coated on the end portion of the support 34 may be prevented from spreading to the first plane surface 31.

The protrusion 35 may be formed of the same material as the support 34 and integrated with the support 34. However, the material of the protrusion 35 may not be limited thereto.

Figure 8A:
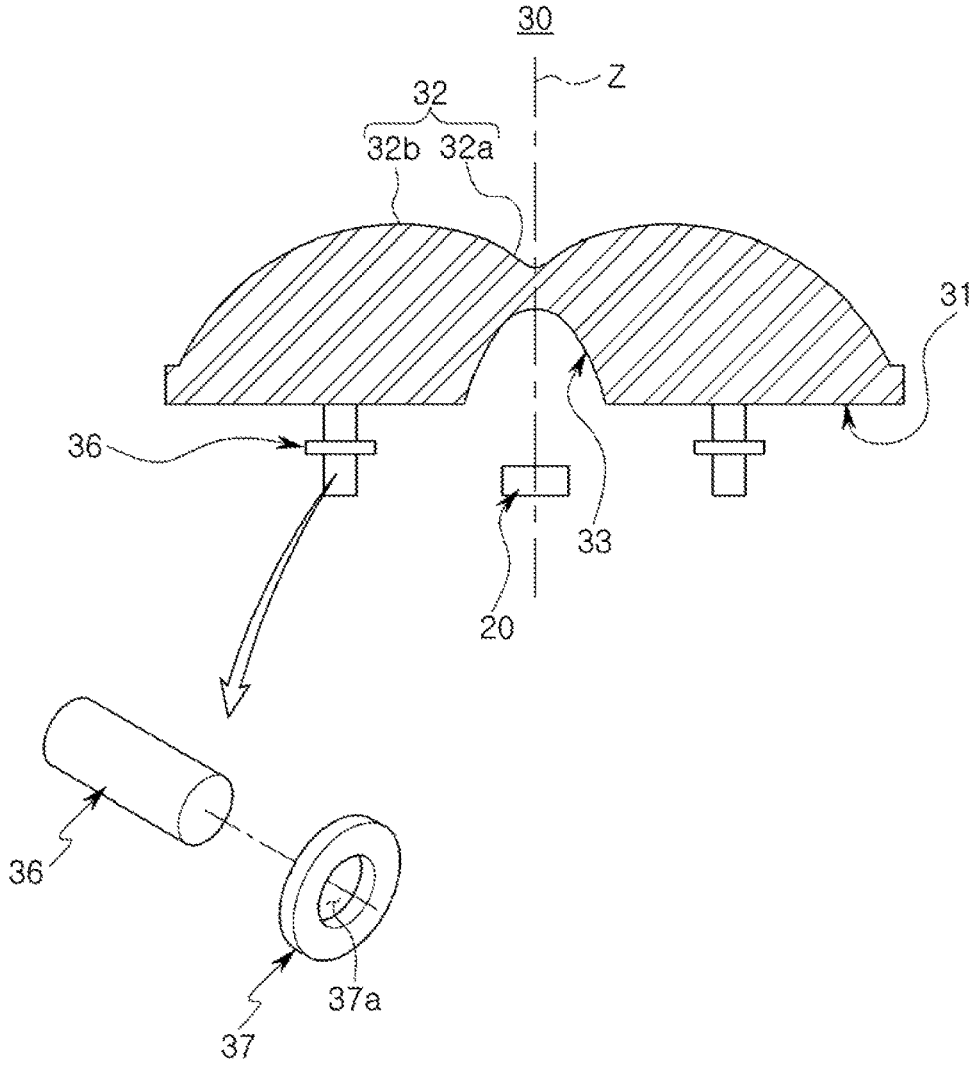
FIGS. 8A-8C schematically illustrates modified examples of a support of the optical device in FIG. 4.

In one embodiment as illustrated in FIG. 8A, a protrusion 37 may be formed as a separate component from a support 36.

Figure 8B:
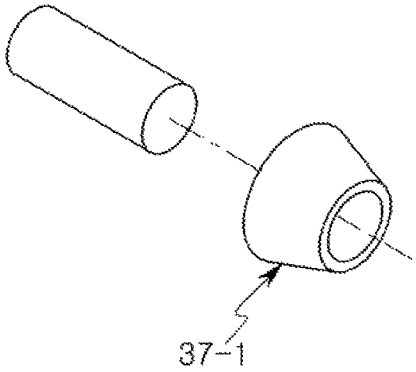
Figure 8C:
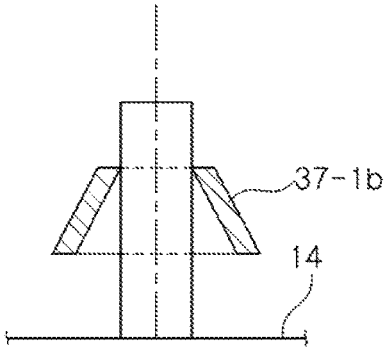

The protrusion 37 may have a ring shape including a through-hole 37*a*. In addition, the protrusion 37 may be inserted to the support 36 through the through-hole 37*a* to be fixed. In this case, the location at which the protrusion 37 is fixed may be optionally adjusted according to a designed structure and/or the reflow process In another embodiment as shown in FIGS. 8B and 8C, the protrusion 37-1 may be a cone shape with a surface sloped toward the top surface of the substrate 10. That is, the protrusion may have an inclined surface 37-1*b* toward the top surface 14 of the substrate or may be formed having an angle to the top surface 14 of the substrate.

It should be appreciated that the protrusion may be any suitable shape that blocks the spreading of the adhesive toward the first plane surface 31 of the optical device 30.

The optical device 30 may be formed of a resin material having translucency, for example, polycarbonate (PC), polymethylmethacrylate (PMMA), and acrylic. In addition, the optical device 30 may be formed of a glass material, but is not limited thereto.

The optical device 30 may include a light-spreading material in the range of 3% to 15%, approximately. As the light-spreading material, for example, at least one material selected from the group consisting of $SiO_2$, $TiO_2$, and $Al_2O_3$ may be included. When the content of the light-spreading material is less than 3%, there may be a problem in that a light-spreading effect is not obtained since light is not sufficiently spread. In addition, when the content of the light-spreading material is more than 15%, the amount of light emitted externally through the optical device 30 may be reduced, and thus light extraction efficiency may be decreased.

The optical device 30 may be formed by injecting a fluidal solvent into a mold and solidifying the fluidal solvent. For example, the optical device 30 may be formed by injection molding, transfer molding, compression molding, or the like.

Figure 9:
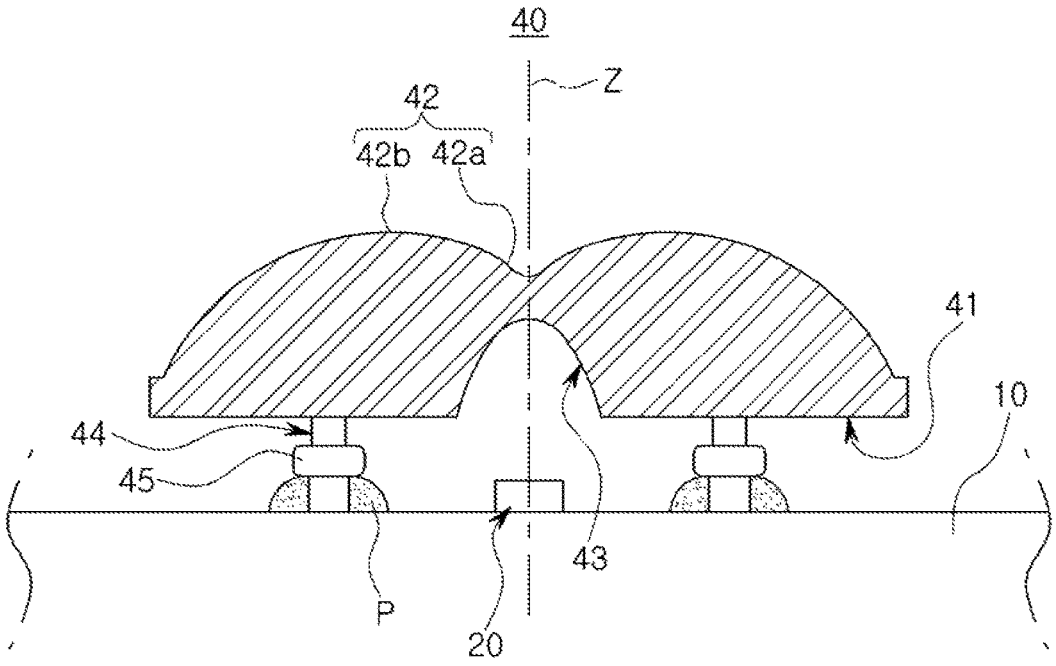
FIG. 9 is a perspective view schematically illustrating an optical device according to another exemplary embodiment of the present inventive concept.
Figure 10A:
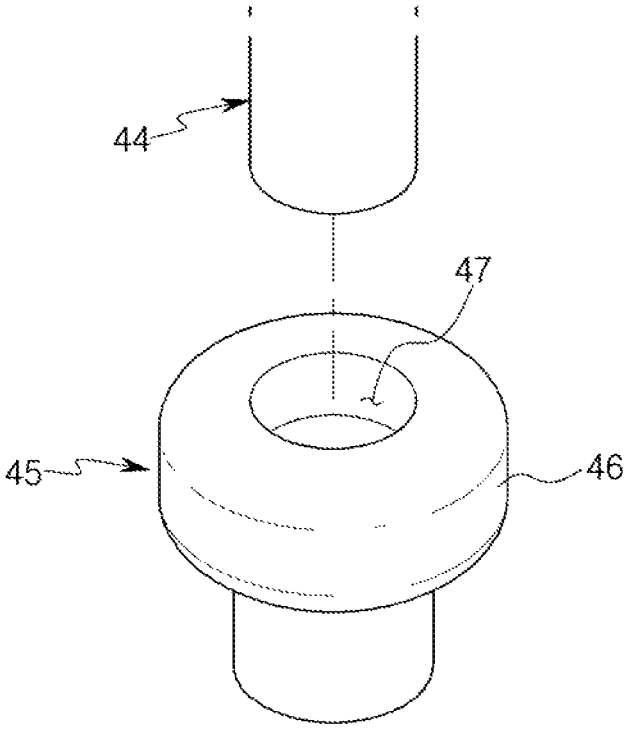
FIGS. 10A and 10B are respectively a perspective view and a cross-sectional view schematically illustrating a support of FIG. 9.
Figure 10B:
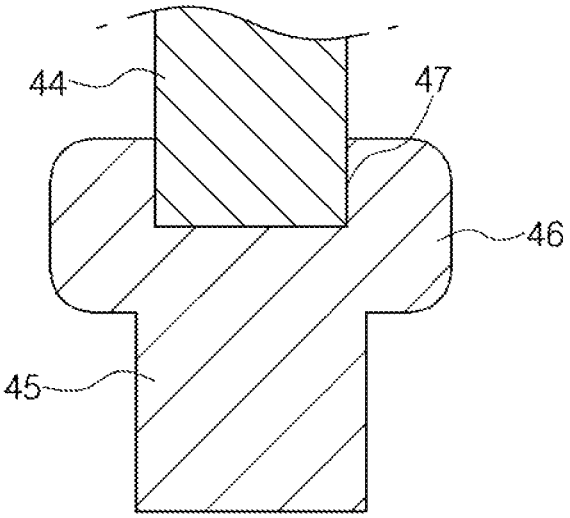

An optical device according to another exemplary embodiment of the present inventive concept will be described with reference to FIGS. 9 and 10. FIG. 9 is a cross-sectional view schematically illustrating an optical device according to another exemplary embodiment of the present inventive concept, and FIGS. 10A and 10B are respectively a perspective view and a cross-sectional view schematically illustrating a support of FIG. 9.

A basic configuration of the optical device 40 according to the exemplary embodiment illustrated in FIGS. 9 and 10 may be substantially the same as that of the optical device 30 according to the exemplary embodiment illustrated in FIGS. 4 to 8. However, since a structure of a support 44 is different from the support 34 according to the exemplary embodiment illustrated in FIGS. 4 to 8, duplicated descriptions will be omitted and the structure of the support will be mainly described hereinafter.

Referring to FIGS. 9 and 10, the optical device 40 according to the exemplary embodiment of the present inventive concept may include a first plane surface 41 disposed on a light source 20, a second plane surface 42 disposed opposite to the first plane surface 41, and a first support 44 and a second support 45 disposed on the first plane surface 41.

The first plane surface 41 may be a surface disposed on or above the light source 20 and facing the light source 20, and may correspond to a bottom surface of the optical device 40.

The first plane surface 41 may include a groove depression 43 recessed in a light-emitting direction in a center portion thereof. The groove depression 43 may have a structure rotationally symmetrical with respect to the optical axis Z passing the center portion of the optical device 40, and a surface thereof may be defined as a plane of incidence on which light emitted by the light source 20 is incident.

The second plane surface 42 may be disposed opposite to the first plane surface 41. The second plane surface 42 may define a light-emitting plane in which light entered through the groove depression 43 is emitted externally, and corresponds to an upper surface of the optical device 40.

The second plane surface 42 may include a first curved surface 42*a* recessed along the optical axis Z toward the groove depression 43 to have a concavely curved surface, and a second curved surface 42*b* extending continuously from an edge of the first curved surface 42*a* to the edge of the first plane surface 41 to have a convexly curved surface.

Basic structures of the first plane surface 41 and the second plane surface 42 may be substantially the same as those of the first plane surface 31 and the second plane surface 32 described with reference to FIGS. 4 and 5. Accordingly, detailed descriptions thereof will be omitted.

The first support 44 may protrude toward the light source 20 and may be disposed on the first plane surface 41. At least two first supports 44 may be disposed on the first plane surface 41. In addition, the first supports 44 may be arranged around the groove depression 43 which is in the center portion of the first plane surface 41.

The first support 44 may have a bar-shaped structure and extend parallel to the optical axis Z. The first support 44 may be formed of the same material as the optical device 40, and integrated with the optical device 40.

The second support 45 may be disposed on an end portion of the first support 44. In addition, the second support 45 may extend in a longitudinal direction to be aligned with the first support 44. When the optical device 40 is mounted on the substrate 10, the second support 45 may be fixed to the substrate 10 by an adhesive P.

The second support 45 may include a fastening hollow 47 on a surface in contact with the first support 44. The first support 44 may be partially inserted into the fastening hollow 47 and fastened to the second support 45. The second support 45 may be fixed in combination with the first support 44 through the fastening hollow 47.

The second support 45 may include a protrusion 46 radially protruding from a side surface thereof. The protrusion 46 may have a structure laterally extending in a direction perpendicular to a longitudinal direction of the second support 45 at an end portion of the second support 45 in contact with the first support 44. For example, the protrusion 46 may extend in a disc shape, with the second support 45 as a center. In addition, the second support 45 may form a T-shaped structure overall, together with the protrusion 46. The protrusion 46 may form a structure such as an engaging shoulder between the first support 44 and the second support 45, and function to prevent the adhesive P coated on the end portion of the second support 45 from spreading to the first plane surface 41 along the first support 44.

The second support 45 may be formed of the same material as the first support 44. In addition, the second support 45 may be formed of a metal. In this case, the second support 45 may be formed at an end of the first support 44 through metal coating.

It will be appreciated that a support is not limited to the exemplary embodiments. The support can be any configuration that functions to support an optical device and prevent or reduce the spreading of the adhesive attaching to a lower end of the support to the optical device during amounting and/or a reflow processes. For example, the support may include an elongated portion substantially parallel to an optical axis Z and a protrusion extending away from the elongated portion. In one example, the protrusion may have a surface parallel to the top surface of the substrate, and is formed around the elongated portion and symmetrically relative to the elongated portion. In another example, the protrusion may be formed asymmetrically relative to the elongated portion.

Thus, since the optical device 30 according to the exemplary embodiment of the present inventive concept, unlike normal optical devices, includes the protrusion 35 having an engaging shoulder structure protruding from the central position of the support 34, the adhesive P may be prevented from spreading to a bottom surface of the optical device 30, that is, the first plane surface 31. Accordingly, the adhesive P may be prevented from attaching to the first plane surface 31 (please refer to FIG. 7).

The adhesive P may be an epoxy adhesive. In addition, the adhesive P may include a solder cream. In particular, when the second support 45 is formed of a metal, the optical device 40 may be attached to the substrate 10 using the solder cream as an adhesive, similar to a case in which a normal electronic device is mounted.

Figure 12:
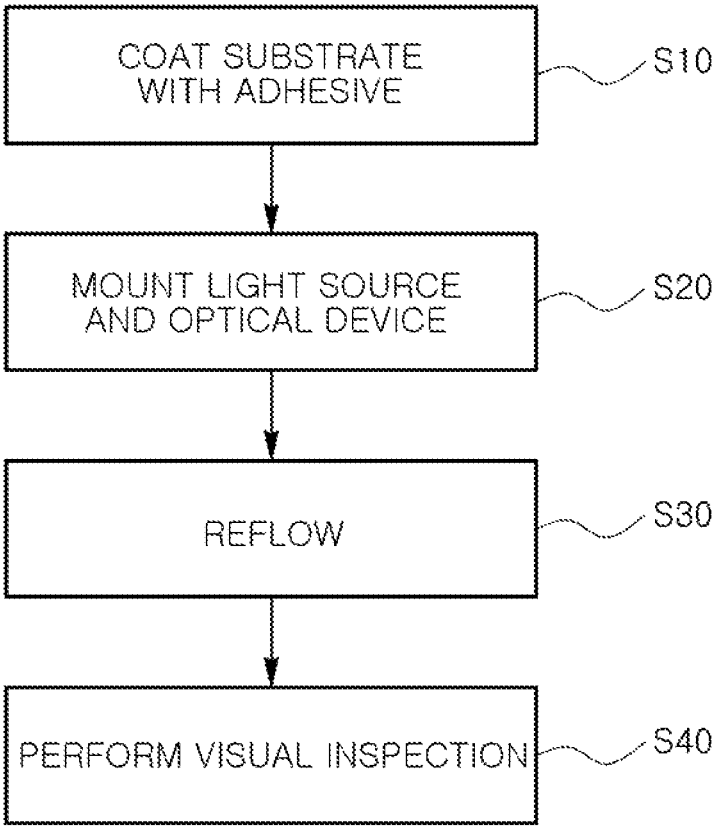
FIG. 12 is a flowchart schematically illustrating a method of fabricating a light source module according to an exemplary embodiment of the present inventive concept.

Hereinafter, a method of fabricating a light source module according to an exemplary embodiment of the present disclosure will be described with reference to FIG. 12 together with FIGS. 1 and 2. FIG. 12 is a schematic flowchart illustrating a method of fabricating a light source module according to an exemplary embodiment of the present disclosure.

First, an adhesive P may be coated on a substrate 10 (S10). The adhesive P may be coated on a light source mounting area 12 and a fiducial mark 11 disposed on the substrate 10 using screen printing. The adhesive P may include an epoxy adhesive or a solder cream.

Next, a light source 20 and an optical device 30 may be mounted on the substrate 10 (S20). The light source 20 and the optical device 30 may be respectively mounted on the light source mounting area 12 and fiducial mark 11 of the substrate 10. In addition, circuit components, such as a connector 50 and a capacitor (not illustrated) may be further mounted on the substrate 10.

Next, a reflow process may be performed at a predetermined temperature (S30). Through such a reflow process, the light source 20 and the optical device 30 may be tightly fixed to the substrate 10 by the adhesive P.

Next, visual inspection to examine whether the light source module is defective or not may be performed (S40). The visual inspection may be performed using an inspection apparatus or directly performed by an operator. The light source module 100 determined as being non-defective may be shipped as a product through a packaging process.

Thus, in the method of fabricating a light source module according to the exemplary embodiment of the present disclosure, the light source and the optical device are simultaneously mounted on the substrate, and attached through a single reflow process. Accordingly, compared to a normal method in which the light source and the optical device are mounted respectively through separate processes, the method may have an advantage in that time and costs for fabricating the light source module are reduced.

That is, a normal method of fabricating a light source module may include mounting circuit components including a light source on a substrate, performing a reflow process, and then performing a visual inspection to examine whether the light source module is defective or not. The method may further include coating the light source module determined as being non-defective with an adhesive, mounting an optical device, performing a reflow process, and then performing a visual inspection before shipping a final product.

Thus, since a lens attachment process is required in addition to a light-source attachment process, manufacturing costs and time may increase due to an epoxy adhesive injection apparatus, a hardening and reflowing apparatus, and the additional process.

According to the exemplary embodiment of the present disclosure, since a light source and an optical device are simultaneously mounted on a substrate, such problems may be solved. In particular, since a support fixing the optical device on the substrate may be partly formed of a metal, a solder cream may be used as an adhesive such as in the case of the light source. Accordingly, additional processes and apparatuses for attaching the optical device to the substrate may be omitted. In addition, since the support includes a protrusion having an engaging shoulder structure, the adhesive may be prevented from spreading into a bottom of the optical device and being stuck thereto.

Figure 13:
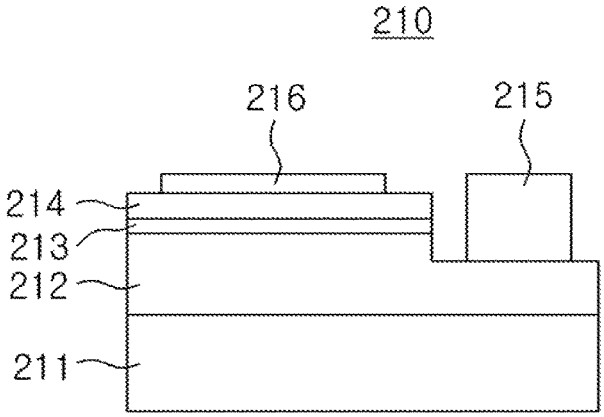
FIGS. 13 to 15 are cross-sectional views illustrating various examples of an LED chip usable as a light source according to an exemplary embodiment of the present inventive concept.
Figure 14:
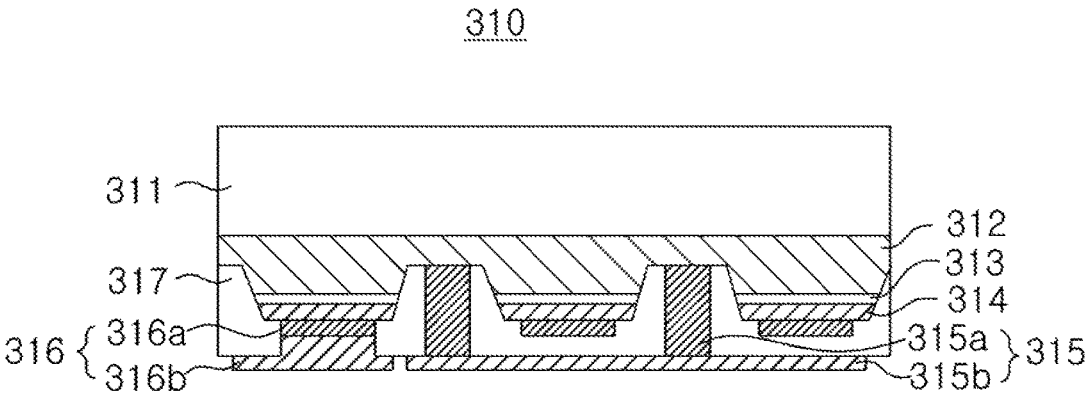
Figure 15:
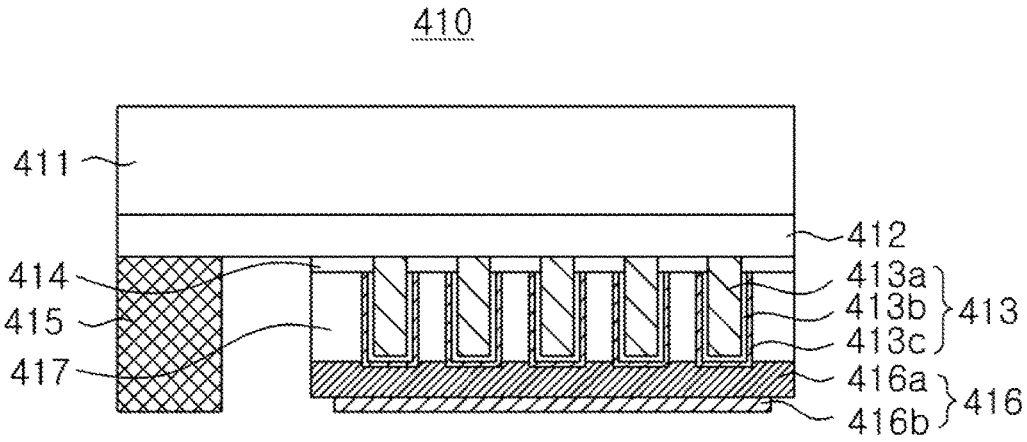

LED chips according to various exemplary embodiments of the present disclosure will be described with reference to FIGS. 13 to 15. FIGS. 13 to 15 are cross-sectional views illustrating various examples of an LED chip usable as a light source.

Referring to FIG. 13, an LED chip 210 may include a first conductivity-type semiconductor layer 212, an active layer 213, and a second conductivity-type semiconductor layer 214, sequentially stacked on a growth substrate 211.

The first conductivity-type semiconductor layer 212 stacked on the growth substrate 211 may be an n-type nitride semiconductor layer doped with n-type impurities. In addition, the second conductivity-type semiconductor layer 214 may be a p-type nitride semiconductor layer doped with p-type impurities. However, in some embodiments, the first and second conductivity-type semiconductor layers 212 and 214 may be stacked interchangeably. Such first and second conductivity-type semiconductor layers 212 and 214 may have a compositional formula of $Al_xIn_yGa_{(1-x-y)}N$ (here, $0 \le x < 1$, $0 \le y < 1$, and $0 \le x+y < 1$), for example, GaN, AlGaN, InGaN, or AlInGaN.

The active layer 213 disposed between the first and second conductivity-type semiconductor layers 212 and 214 may emit light having a predetermined energy, generated by electron-hole recombination. The active layer 213 may include a material having a smaller energy bandgap than the first and second conductivity-type semiconductor layers 212 and 214. For example, when the first and second conductivity-type semiconductor layers 212 and 214 are GaN-based compound semiconductors, the active layer 213 may include an InGaN-based compound semiconductor having a smaller energy bandgap than GaN. In addition, the active layer 213 may have a multiple quantum well (MQW) structure, for example, an InGaN/GaN structure, in which quantum well layers and quantum barrier layers are alternately stacked. However, the active layer 213 may not be limited thereto, and may have a single quantum well (SQW) structure.

The LED chip 210 may include first and second electrode pads 215 and 216 electrically connected to the first and second conductivity-type semiconductor layers 212 and 214, respectively. The first and second electrode pads 215 and 216 may be exposed and disposed in the same direction. In addition, the first and second electrode pads 215 and 216 may be electrically connected to a substrate by a wire bonding method or a flip-chip bonding method.

An LED chip 310 illustrated in FIG. 14 may include a semiconductor laminates formed on a growth substrate 311. The semiconductor laminates may include a first conductivity-type semiconductor layer 312, an active layer 313, and a second conductivity-type semiconductor layer 314.

The LED chip 310 may include first and second electrode pads 315 and 316 respectively connected to the first and second conductivity-type semiconductor layers 312 and 314.

The first electrode pad 315 may include a conductive via 315*a* passing through the second conductivity-type semiconductor layer 314 and the active layer 313 to be connected to the first conductivity-type semiconductor layer 312, and an electrode extension portion 315*b* connected to the conductive via 315*a*. The conductive via 315*a* may be surrounded by an insulating layer 317 to be electrically isolated from the active layer 313 and the second conductivity-type semiconductor layer 314. The conductive via 315*a* may be disposed on an area where the semiconductor laminates is etched. The number, shape, or pitch of the conductive via 315*a*, or a contact area with the first conductivity-type semiconductor layer 312 may be appropriately designed to reduce contact resistance. In addition, the conductive via 315*a* may be arranged in rows and columns on the semiconductor laminates to improve current flow.

The second electrode pad 316 may include an ohmic contact layer 316*a* and an electrode extension portion 316*b* on the second conductivity-type semiconductor layer 314.

An LED chip 410 illustrated in FIG. 15 may include a growth substrate 411, a first conductivity-type semiconductor base layer 412 formed on the growth substrate 411, and a plurality of light-emitting nanostructures 413 formed on the first conductivity-type semiconductor base layer 412. In addition, the LED chip 410 may further include an insulating layer 414 and a filling part 417.

The light-emitting nanostructure 413 may include a first conductivity-type semiconductor core 413*a*, an active layer 413*b* and a second conductivity-type semiconductor layer 413*c*, sequentially formed as shell layers on a surface of the first conductivity-type semiconductor core 413*a*. In the present exemplary embodiment, it is illustrated that each of the light-emitting nanostructures 413 has a core-shell structure, but the structure of the light-emitting nanostructures 413 is not limited thereto and each of the light-emitting nanostructures 413 may have any other structure such as a pyramid structure.

The first conductivity-type semiconductor base layer 412 may be a layer providing a growth plane for the light-emitting nanostructure 413. The insulating layer 414 may provide an open area for growing the light-emitting nanostructure 413, and may be a dielectric material, such as $SiO_2$ or $SiN_x$. The filling part 417 may structurally stabilize the light-emitting nanostructure 413 and function to transmit or reflect light. Meanwhile, when the filling part 417 includes a light-transmitting material, the filling part 417 may be formed of a transparent material, such as $SiO_2$, SiNx, an elastic resin, silicone, an epoxy resin, a polymer, or plastic. As needed, when the filling part 417 includes a reflective material, the filling part 417 may be formed of a polymer material such as polyphthalamide (PPA), and a high reflective metal powder or a ceramic powder. The high reflective ceramic powder may be at least one selected from the group consisting of $TiO_2$, $Al_2O_3$, $Nb_2O_5$, $Al_2O_3$, and ZnO. The high reflective metal may be Al or silver Ag.

The first and second electrode pads 415 and 416 may be disposed on a lower surface of the light-emitting nanostructure 413. The first electrode pad 415 may be disposed on an exposed surface of the first conductivity-type base layer 412, and the second electrode pad 416 may include an ohmic contact layer 416*a* and an electrode extension portion 416*b*, formed under the light-emitting nanostructure 413 and the filling part 417. Otherwise, the ohmic contact layer 416*a* and the electrode extension portion 416*b* may be formed integrally.

Various lighting apparatuses including a light source module according to an exemplary embodiment of the present disclosure will be described with reference to FIGS. 16 to 18.

Figure 16:
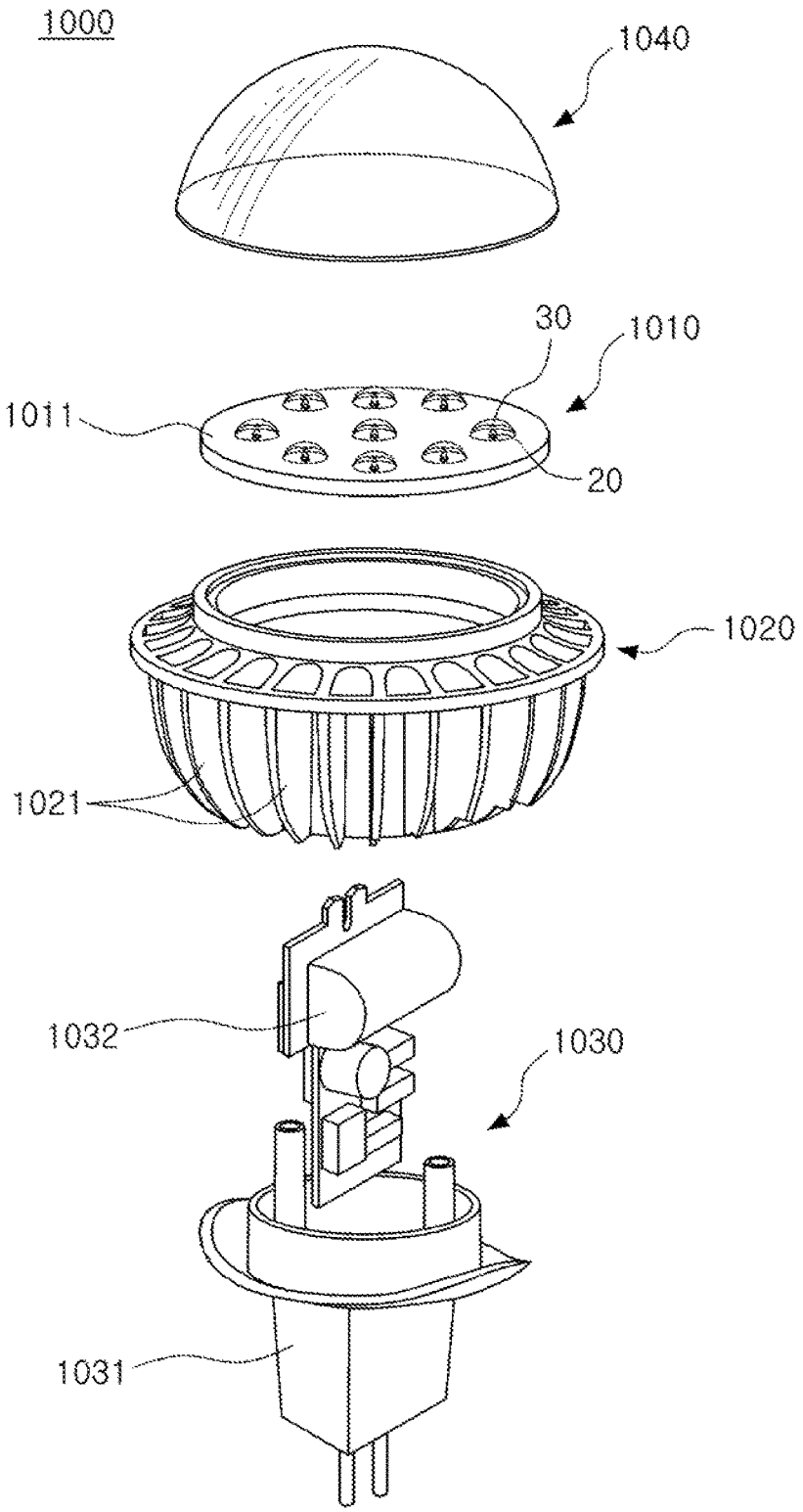
FIG. 16 is an exploded perspective view schematically illustrating a (bulb type) lighting apparatus according to an exemplary embodiment of the present inventive concept.

FIG. 16 schematically illustrates a lighting apparatus according to an exemplary embodiment of the present disclosure.

Referring to FIG. 16, a lighting apparatus 1000 according to the exemplary embodiment of the present disclosure may be a bulb-type lamp, and may be used as an indoor lighting device, for example, a downlight.

The lighting apparatus 1000 may include a housing 1020 having an electrical connection structure 1030, and a light source module 1010 mounted on the housing 1020. In addition, the lighting apparatus 1000 may further include a cover 1040 mounted on the housing 1020 and covering the light source module 1010.

The light source module 1010 may be substantially the same as the light source module 100 described with reference to FIG. 1. Accordingly, detailed descriptions thereof will be omitted. The light source module 1010 may include a plurality of light sources 20 and a plurality of optical devices 30 mounted on a substrate 1011.

The housing 1020 may function as a frame supporting the light source module 1010, and a heat sink emitting heat generated in the light source module 1010 to the outside. For this, the housing 1020 may be formed of a rigid material having a high thermal conductivity, for example, a metal such as Al, a heat-dissipating resin, or the like.

A plurality of heat-dissipating fins 1021 for increasing a surface area in contact with ambient air to improve a heat-dissipating efficiency may be formed on an outer side surface of the housing 1020.

An electrical connection structure 1030 electrically connected to the light source module 1010 may be disposed on the housing 1020. The electrical connection structure 1030 may include a terminal 1031, and a driver 1032 supplying driving power received through the terminal 1031 to the light source module 1010.

The terminal 1031 may install the lighting apparatus 1000 in a socket, for example, to be fixed and electrically connected thereto. In the exemplary embodiment of the present disclosure, the terminal 1031 is described as having a sliding pin-type structure, but is not limited thereto. As needed, the terminal 1031 may have an Edison-type structure installed by turning a screw thread.

The driver 1032 may function to convert external driving power into an appropriate current source for driving the light source module 1010 and supply the converted current source. The driver 1032 may include, for example, an AC-DC converter, parts for a rectifier circuit, a fuse, or the like. In addition, the driver 1032 may further include a communication module implementing a remote control function, as needed.

The cover 1040 may be installed in the housing 1020 to cover the light source module 1010, and may have a convex lens shape or a bulb shape. The cover 1040 may be formed of a light-transmitting material, and include a light-spreading material.

Figure 17:
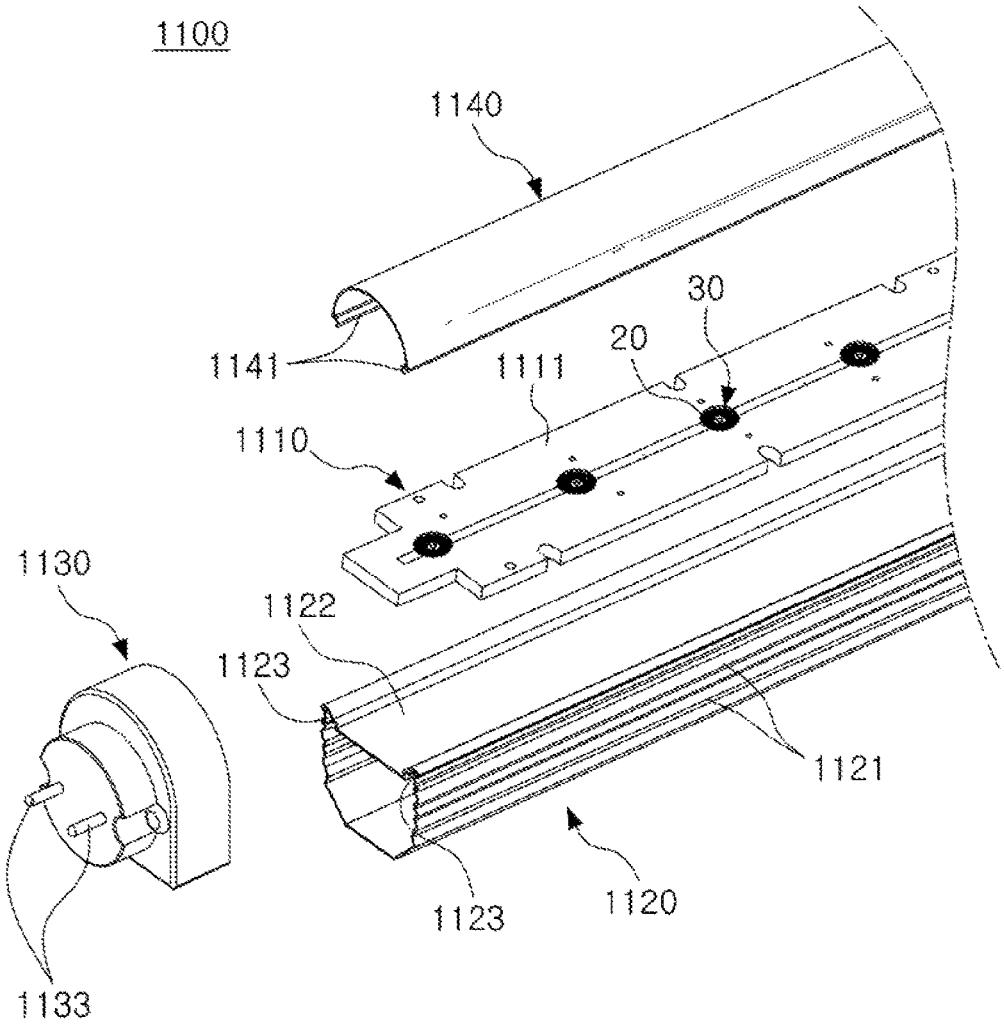
FIG. 17 is an exploded perspective view schematically illustrating a (L-lamp type) lighting apparatus according to an exemplary embodiment of the present inventive concept.

FIG. 17 is an exploded perspective view schematically illustrating a lighting apparatus according to another exemplary embodiment of the present disclosure. Referring to FIG. 17, a lighting apparatus 1100 may be, for example, a bar-type lamp, and include a light source module 1110, a housing 1120, a terminal 1130, and a cover 1140.

The light source module 1110 may be substantially the same as the light source module 100 illustrated in FIG. 1. Accordingly, detailed descriptions thereof will be omitted. The light source module 1110 may include a plurality of light sources 20 and a plurality of optical devices 30 mounted and arranged along a substrate 1111.

The housing 1120 may have the light source module 1110 mounted on and fixed to one surface 1122 thereof, and release heat generated in the light source module 1110 to the outside. In this regard, the housing 1120 may be formed of a material having a high thermal conductivity, for example, a metal, and a plurality of heat dissipating fins 1121 may be formed to protrude on both side surfaces thereof.

The cover 1140 may be fastened to a fastening hollow 1123 of the housing 1120 to cover the light source module 1110.

In addition, the cover 1140 may have a semi-circularly curved surface so that light generated in the light source module 1110 is uniformly emitted externally overall. An overhanging 1141 engaged with the fastening hollow 1123 of the housing 1120 may be formed in a longitudinal direction on a bottom surface of the cover 1140.

The terminal 1130 may be disposed at least open one of two end portions of the housing 1120 in the longitudinal direction to supply power to the light source module 1110. The terminal 1130 may further include an electrode pin 1133 protruding outwardly.

Figure 18:
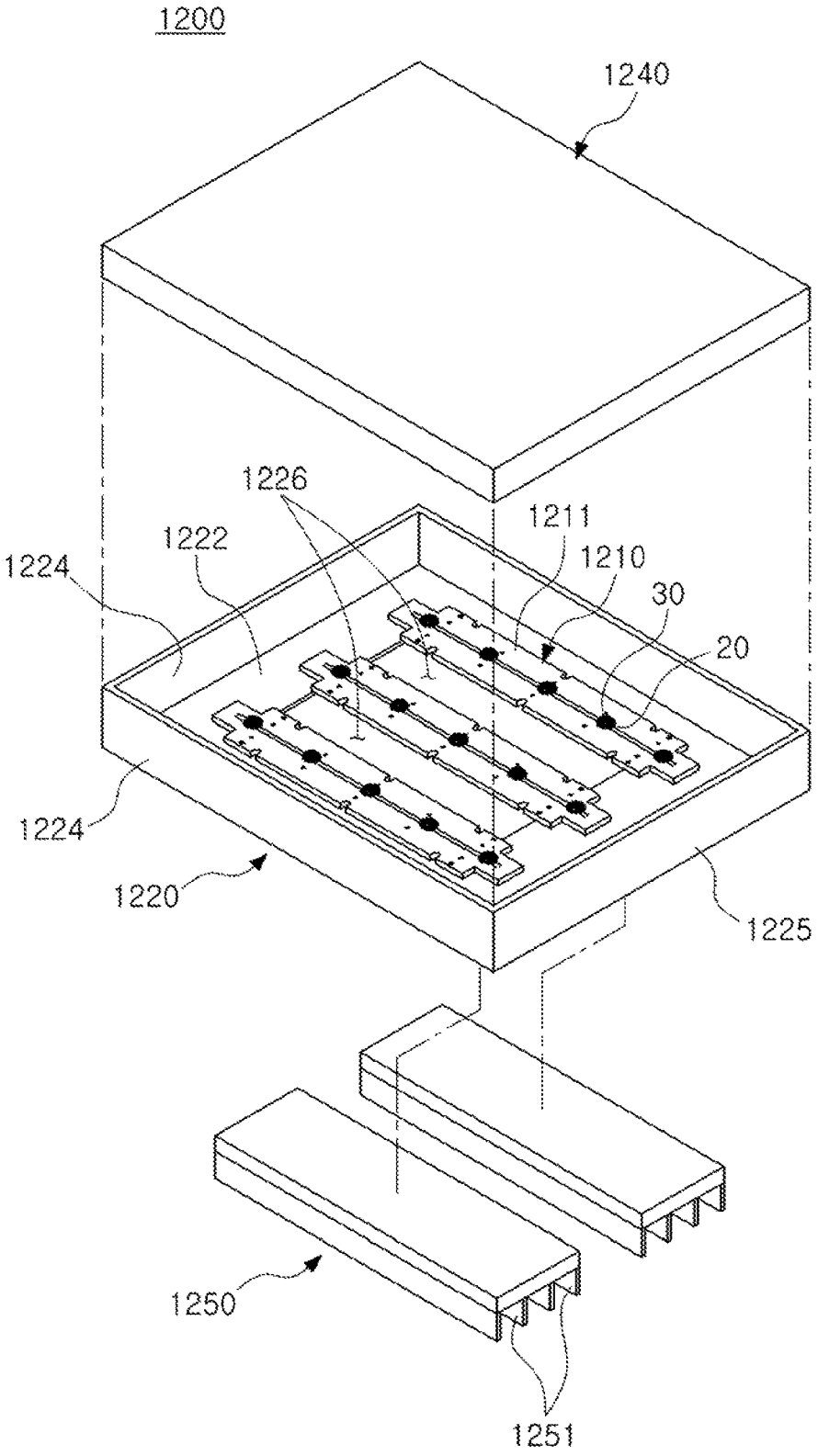
FIG. 18 is an exploded perspective view schematically illustrating a (plate type) lighting apparatus according to an exemplary embodiment of the present inventive concept.

FIG. 18 is an exploded perspective view schematically illustrating a lighting apparatus according to another exemplary embodiment of the present disclosure. Referring to FIG. 18, a lighting apparatus 1200 may have, for example, a surface light source type structure, and include a light source module 1210, a housing 1220, a cover 1240, and a heat sink 1250.

The light source module 1210 may be substantially the same as the light source module 100 illustrated in FIG. 1.

Accordingly, detailed descriptions thereof will be omitted. The light source module 1210 may include a plurality of light sources 20 and a plurality of optical devices 30 mounted and arranged along a substrate 1211.

The housing 1220 may have a box-type structure including one surface 1222 on which the light source module 1210 is mounted, and a side surface 1224 extending from edges of the one surface 1222. The housing 1220 may be formed of a material having a high thermal conductivity, for example, a metal, so as to release heat generated in the light source module 1210 to the outside.

A hole 1226 to which a heat sink 1250, to be described later, is to be inserted and engaged may be formed to pass through the one surface 1222 of the housing 1220. In addition, the substrate 1211 of the light source module 1210 mounted on the one surface 1222 may be partly engaged on the hole 1226 to be exposed to the outside.

The cover 1240 may be fastened to the housing 1220 to cover the light source module 1210. In addition, the cover 1240 may have a flat structure overall.

The heat sink 1250 may be engaged with the hole 1226 through the other surface 1225 of the housing 1220. In addition, the heat sink 1250 may be in contact with the light source module 1210 through the hole 1226 to release heat generated in the light source module 1210 to the outside. In order to increase heat dissipating efficiency, the heat sink 1250 may include a plurality of heat dissipating fins 1251. The heat sink 1250, like the housing 1220, may be formed of a material having a high thermal conductivity.

Lighting apparatuses using light emitting devices may be roughly divided into indoor lighting apparatuses and outdoor lighting apparatuses according to purposes thereof. The indoor LED lighting apparatuses may be bulb-type lamps, fluorescent lamps (LED-tubes), or flat-type lighting apparatuses, and mainly for retrofitting existing lighting apparatuses. The outdoor LED lighting apparatuses may be street lights, guard lamps, floodlights, decorative lights, or traffic lights.

In addition, such an LED lighting apparatus may be utilized as interior or exterior light sources for vehicles. As interior light sources, the LED lighting apparatuses may be used as various light sources for vehicle interior lights, such as reading lamps, and instrument panels. As exterior light sources, the LED lighting apparatuses may be used as all types of light sources, such as headlights, brake lights, turn indicators, fog lights, and running lights.

Further, the LED lighting apparatuses may be used as light sources for robots or various types of mechanical equipment. In particular, an LED lighting apparatus using light within a particular wavelength band may promote the growth of plants, or stabilize the mood of a person or cure diseases as an emotional lighting apparatus.

As set forth above, according to the exemplary embodiments of the present disclosure, a light source module capable of preventing generation of speckles, uniformizing light distribution, and simplifying manufacturing processes thereof, can be provided.

While exemplary embodiments have been shown and described above, it will be apparent to those skilled in the art that modifications and variations could be made without departing from the scope of the invention as defined by the appended claims.

What is claimed is:

1. A light source module, comprising:

a substrate;

a light source mounted on the substrate; and an optical device disposed on the light source, wherein the optical device comprises:

a first surface disposed above the light source;

a second surface disposed opposite to the first surface and through which light generated in the light source is emitted externally; and a support disposed on the first surface and fixed to the substrate, wherein the support includes a protrusion protruding around a side surface thereof, wherein the protrusion has a structure extending from a portion spaced apart from the first surface in a lateral direction substantially perpendicular to a longitudinal direction of the support; and wherein the protrusion is spaced apart from an upper surface of the substrate and disposed above the substrate.

2. The light source module of claim 1, wherein the protrusion is formed of the same material as the support and formed integrally with the support.

3. The light source module of claim 1, wherein the protrusion has a ring shape including a through-hole, and is inserted into and fixed to the support through the through-hole.

4. The light source module of claim 1, wherein a portion of the second surface convexly protrudes in a moving direction of light, and a central portion thereof through which an optical axis of the light source passes is concavely recessed toward the light source to have an inflection point.

5. The light source module of claim 1, wherein the second surface includes a first curved surface having a concavely curved portion recessed along an optical axis toward the light source, and a second curved surface having a convexly curved portion extending continuously from an edge of the first curved surface to the edge of the first surface.

6. The light source module of claim 1, wherein the first surface includes a depression recessed in a light-emitting direction in a center portion thereof through which an optical axis of the light source passes.

7. The light source module of claim 6, wherein the depression is disposed to face the light source above the light source, and a cross-sectional area of the depression exposed on the first surface is greater than an area of a light-emitting plane of the light source.

8. A light source module, comprising:

a substrate;

a light source mounted on the substrate; and an optical device disposed on the light source, wherein the optical device comprises:

a first surface facing the light source;

a second surface disposed opposite to the first surface and through which light generated in the light source is emitted externally; and a first support disposed on the first surface, and a second support disposed on an end portion of the first support and fixed to the substrate by an adhesive, wherein the second support includes a protrusion protruding around a side surface thereof.

9. The light source module of claim 8, wherein the protrusion has a structure extending from an end portion of the second support in contact with the first support in a lateral direction substantially perpendicular to a longitudinal direction of the second support.

10. The light source module of claim 8, wherein the second support includes a fastening hollow into which the first support is partially inserted and fastened, on a surface in contact with the first support.

11. The light source module of claim 8, wherein the second support is formed of a resin or a metal.

12. The light source module of claim 8, wherein the adhesive includes an epoxy adhesive or a solder cream.

13. The light source module of claim 8, wherein the light source is a light-emitting diode (LED) chip or an LED package in which the LED chip is mounted.

14. A light source module, comprising:

a substrate;

a light source mounted on a top surface of the substrate; and an optical device disposed above the light source, wherein the optical device comprises:

a first surface facing the light source;

a second surface disposed opposite to the first surface and through which light generated in the light source is emitted externally; and a support with an upper end disposed on the first surface and a lower end mounted to the top surface of the substrate, wherein the support has a lower portion having a bar-shaped structure, an upper portion having the bar-shaped structure, and a protrusion at a middle portion wherein the protrusion extends in a lateral direction away from the bar-shaped structure.

15. The light source module of claim 14, wherein the lower end of the support is fixed to the top surface of the substrate by an adhesive.

16. The light source module of claim 14, wherein the protrusion has a surface substantially parallel to the top surface of the substrate.

17. The light source module of claim 14, wherein the protrusion has an inclined surface toward the top surface of the substrate.

18. The light source module of claim 14, wherein the support comprises at least two supports.

* * * * *